US006243475B1

(12) United States Patent
Nakamura et al.

(10) Patent No.: US 6,243,475 B1
(45) **Date of Patent: *Jun. 5, 2001**

(54) SPEAKER

(75) Inventors: Takeshi Nakamura, Uji; Yoshiaki Heinouchi, Joyo, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/213,043

(22) Filed: Dec. 16, 1998

Related U.S. Application Data

(63) Continuation of application No. 08/864,334, filed on May 28, 1997.

(51) Int. Cl.[7] ..... H04R 25/00

(52) U.S. Cl. ..... 381/190; 381/340; 381/430

(58) Field of Search ..... 381/339, 340, 381/341, 342, 343, 348, 349, 173, 190, 191, 430, FOR 143, 423; 310/322, 324, 800; 29/25.35

(56) References Cited

U.S. PATENT DOCUMENTS 4,401,911 * 8/1983 Ravinet et al. ..... 381/190
4,440,983 * 4/1984 Facoetti et al. ..... 381/190
4,866,683 * 9/1989 Phillips ..... 381/190
5,185,549 * 2/1993 Sullivan ..... 381/190
5,802,196 * 9/1998 Nakamura ..... 381/190
5,896,460 * 4/1999 Nakamura et al. ..... 381/190

FOREIGN PATENT DOCUMENTS

560727 * 4/1944 (GB) ..... 381/FOR 143

* cited by examiner

*Primary Examiner*—Huyen Le
(74) *Attorney, Agent, or Firm*—Keating & Bennett, LLP

(57) ABSTRACT

A speaker has a substantially reduced size, is efficient in the low sound range and is unidirectional relative to the plane of installation or support of the speaker. The speaker includes a vibrator having a semispherical vibrating body made of a piezoelectric material polarized in a thickness direction. Electrodes are provided on the inner and outer surfaces of the vibrating body. A cavity is created inside of the vibrator. A sound path in the form of a horn includes inner parts of a first cylinder which communicates with the cavity, a second cylinder, a third cylinder, a fourth cylinder, a fifth cylinder and other cylinders. Cutouts functioning as openings of the sound path are disposed almost along the whole azimuth of the fifth cylinder at the outside of the horn relative to the plane of speaker support.

32 Claims, 3 Drawing Sheets

SPEAKER

This is a Continuation of U.S. patent application Ser. No. 08/864,334 filed on May 28, 1997.

BACKGROUND OF THE INVENTION

1. Field of the Invention

The present invention relates to a speaker and more particularly to a speaker which is efficient in the low sound range.

2. Description of Prior Art

A conventional speaker used for low sound range has a back load horn arranged such that a sound path is folded to reduce the size of the speaker.

However, the prior art speaker using the back load horn has a directivity because an opening of its sound path is directional.

Further, because the folded part of the sound path has a mere slit or chamfered structure in the prior art speaker using the back load horn, the flow of sound is disturbed at the folded part of the sound path. Therefore, in such a conventional speaker. it is hard to obtain plane waves and the sound is distorted.

SUMMARY OF THE INVENTION

To overcome the problems mentioned above, the preferred embodiments of the present invention provide a speaker which has a substantially reduced size, is efficient in a low sound range and transmits sound waves in all directions relative to a plane of a surface on which the speaker is mounted or supported. The preferred embodiments of the present invention provide a speaker having these features and advantages and also which substantially eliminates turbulence of sound flow.

A speaker according to a preferred embodiment of the present invention comprises a substantially semispherical vibrating body; a driving device for vibrating the vibrating body; and a horn having a sound path which is folded and extends from a curved inner surface of the vibrating body toward an outside of the speaker; wherein a cavity which communicates with the sound path is defined between the vibrating body and the horn and openings of the sound path are arranged such that sound waves are emitted from the openings toward a surface on which the speaker is supported in all directions relative to a plane of the speaker support surface. The horn preferably comprises a plurality of cylinders arranged in a multilevel arrangement having spaces defined between adjacent cylinders, the cylinders being centered around a central axis of the speaker. The sound path includes inner parts of the plurality of cylinders and the openings of the sound path are preferably disposed in an outermost cylinder of the plurality of cylinders. It is preferred if the openings in the sound path extend around an entire circumferential periphery of the speaker.

Thus, the novel structural arrangement resulting from the combination of the semispherical vibrating body and the horn and sound path described above provides a unique combined sound transmission. The unique combined sound transmission is achieved as a result of the semispherical vibrating body transmitting sound waves away from a speaker support surface in all directions relative to the speaker support surface while the unique arrangement of the horn and sound path results in sound waves being transmitted from the openings of the sound path toward the speaker support surface in all directions relative to the speaker support surface.

Another speaker according to the preferred embodiments of the present invention comprises a substantially semispherical vibrating body; a driving device for vibrating the vibrating body; and a horn having a sound path which is folded and extends from a curved inner surface of the vibrating body toward an outside of the speaker; wherein a cavity which communicates with the sound path is created between the vibrating body and the horn; openings of the sound path are arranged in the horn such that sound waves are emitted from the openings toward a surface on which the speaker is supported, in all directions relative to a plane of the speaker support surface; and the folded parts of the sound path and the openings of the sound path are arranged so as to expand from an inner portion to an outer portion of the sound path. It is noted that in the speaker, the horn preferably comprises a plurality of cylinders arranged in a multilevel arrangement having spaces defined between adjacent cylinders, the cylinders being centered about a central axis of the speaker. The sound path includes inner parts of the plurality of cylinders and the folded parts of the sound path preferably comprise substantially V-shaped cutouts formed in the plurality of cylinders and the openings of the sound path comprise substantially V-shaped cutouts formed in an outermost cylinder among the plurality of cylinders.

When an electrical signal is input, the vibrator is vibrated by the vibrating device, thus radiating sound waves from the curved outer surface of the vibrating body and from the curved inner surface of the vibrating body via the cavity and the sound path in the inventive speaker providing a unique combination of sound wave emanation and sound transmission.

Because the vibrating body has a substantially semispherical shape, the sound waves radiated from the curved outer surface of the vibrating body are radiated away from the speaker support surface in all directions relative to the speaker support surface. Further, because the openings of the sound path are arranged around substantially an entire circumference of the speaker, the sound waves radiated from the curved inner surface of the vibrator via the cavity and the sound path of the horn are radiated toward the speaker support surface in all directions relative to the plane of speaker support.

Further, for the inventive speaker, because the horn comprises the plurality of cylinders which are arranged in a multilevel arrangement while providing spaces therebetween and is centered around the central axis of the speaker and has the sound path which expands from the center thereof toward the outside, the speaker has a substantially reduced size despite the long sound path of the horn and the efficiency in the low sound range.

Further, in the preferred embodiments of the inventive speaker, because the folded parts and the openings of the sound path are created so as to expand from an inner portion to an outer portion of the sound path, the sound flows quickly at the portion where the distance of the sound path is longer, i.e. at the outer portion of the folded part of the sound path and the opening of the sound path, and the sound flows slowly at the portion of the sound path where the distance of the sound path is shorter, i.e. at the inner portion of the folded part of the sound path and the opening of the sound path. As a result, the speeds of the sound waves become almost equal at the outer portion and the inner portion of the folded parts and the opening of the sound path and the flow of sound is hardly disturbed at the folded parts and the openings of the sound path.

According to the preferred embodiments of the present invention, a speaker which is small, which is efficient in the low sound range and which generates sound waves which are transmitted in all directions relative to a speaker support surface or installation surface is provided.

Further, according to the preferred embodiments of the present invention, a speaker which is small, is efficient in the low sound range, is omni-directional relative to the speaker support and which hardly disturbs the flow of sound is obtained.

These and other elements, features, and advantages of the preferred embodiments of the present invention will be apparent from the following detailed description of the preferred embodiments of the present invention, as illustrated in the accompanying drawings.

DESCRIPTION OF PREFERRED EMBODIMENTS

Figure 1:
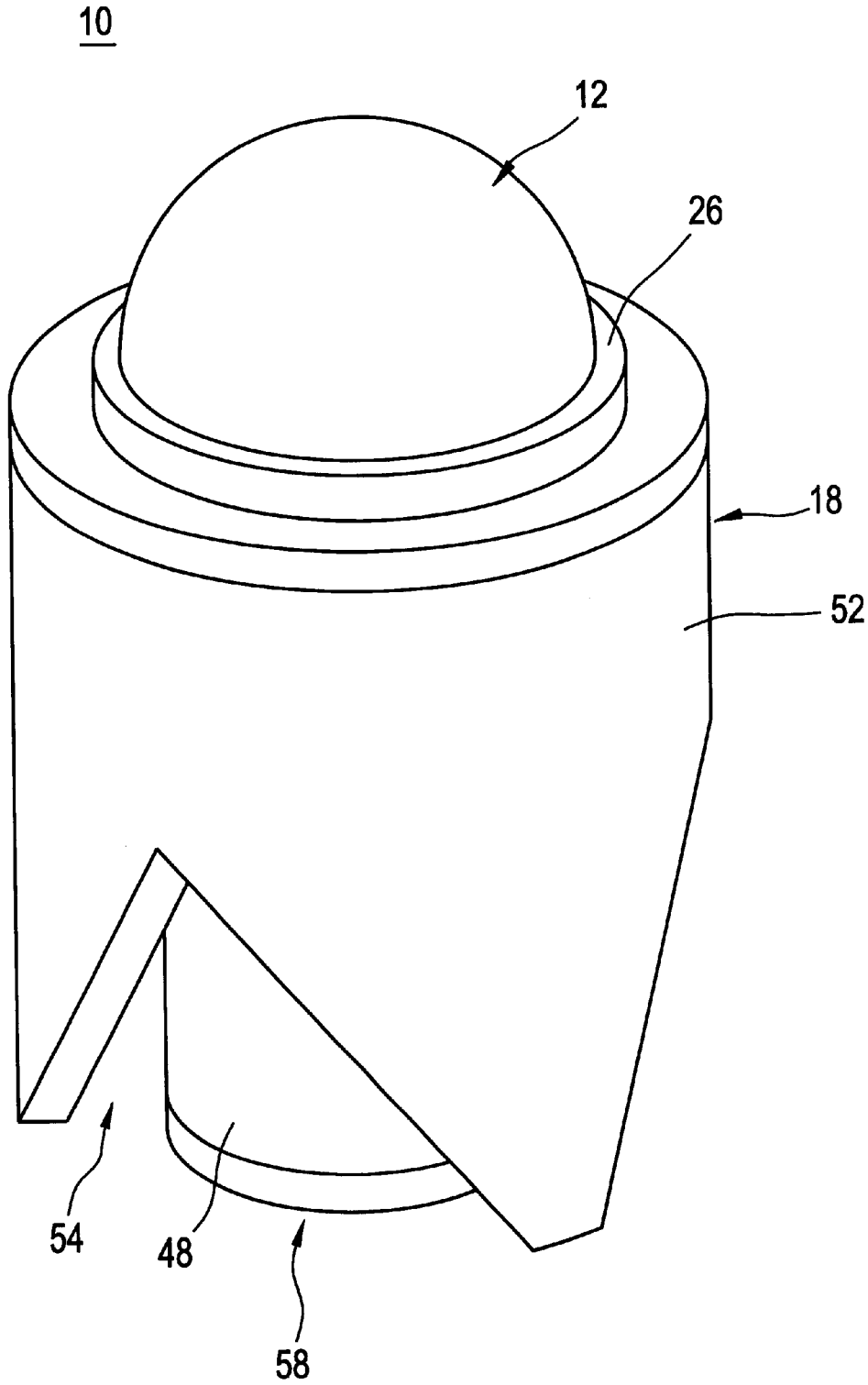
FIG. 1 is a perspective view showing a preferred embodiment of the. present invention.
Figure 2:
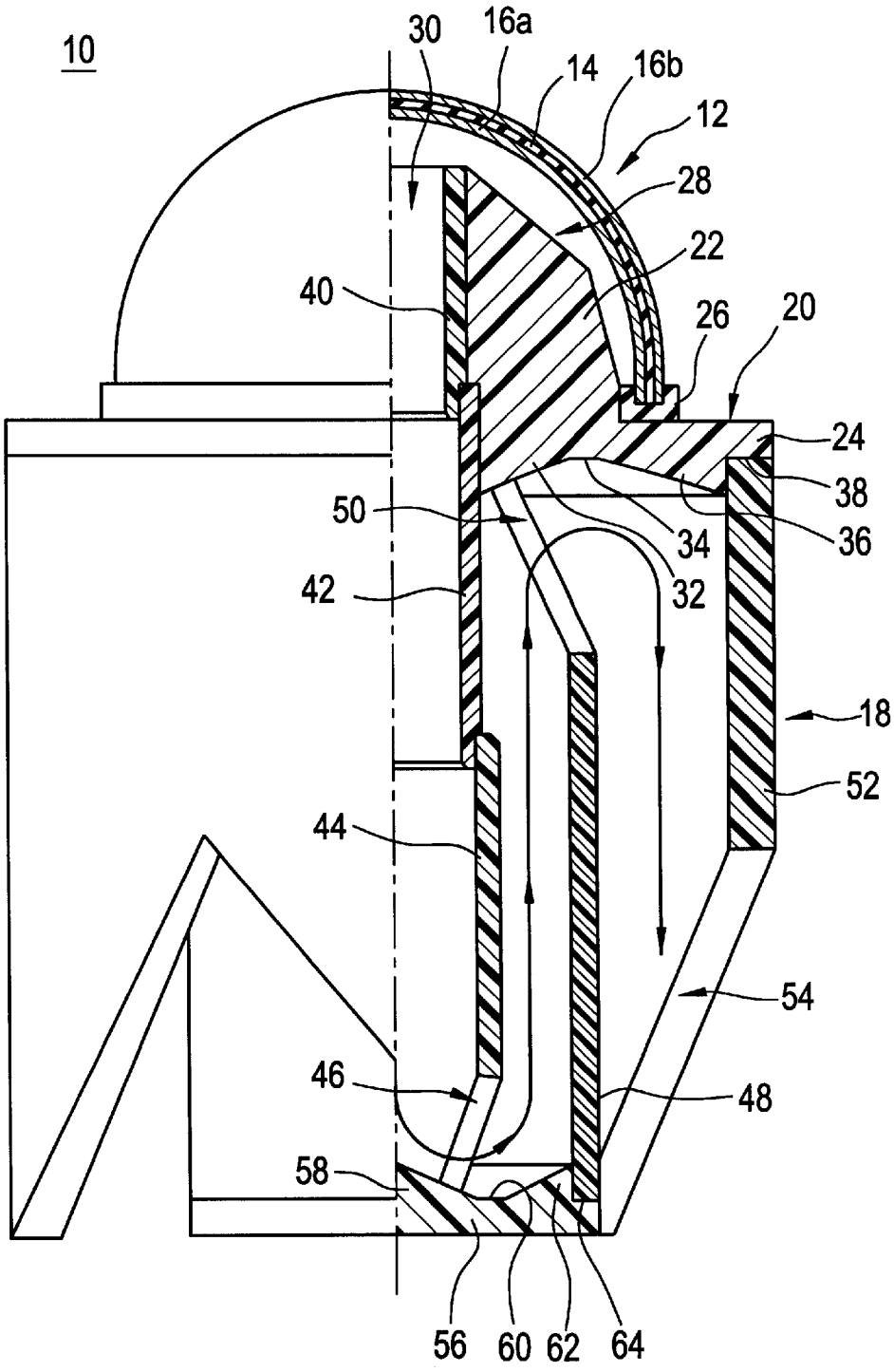
FIG. 2 is a partially sectional diagrammatic view of the speaker shown in FIG. 1.
Figure 3:
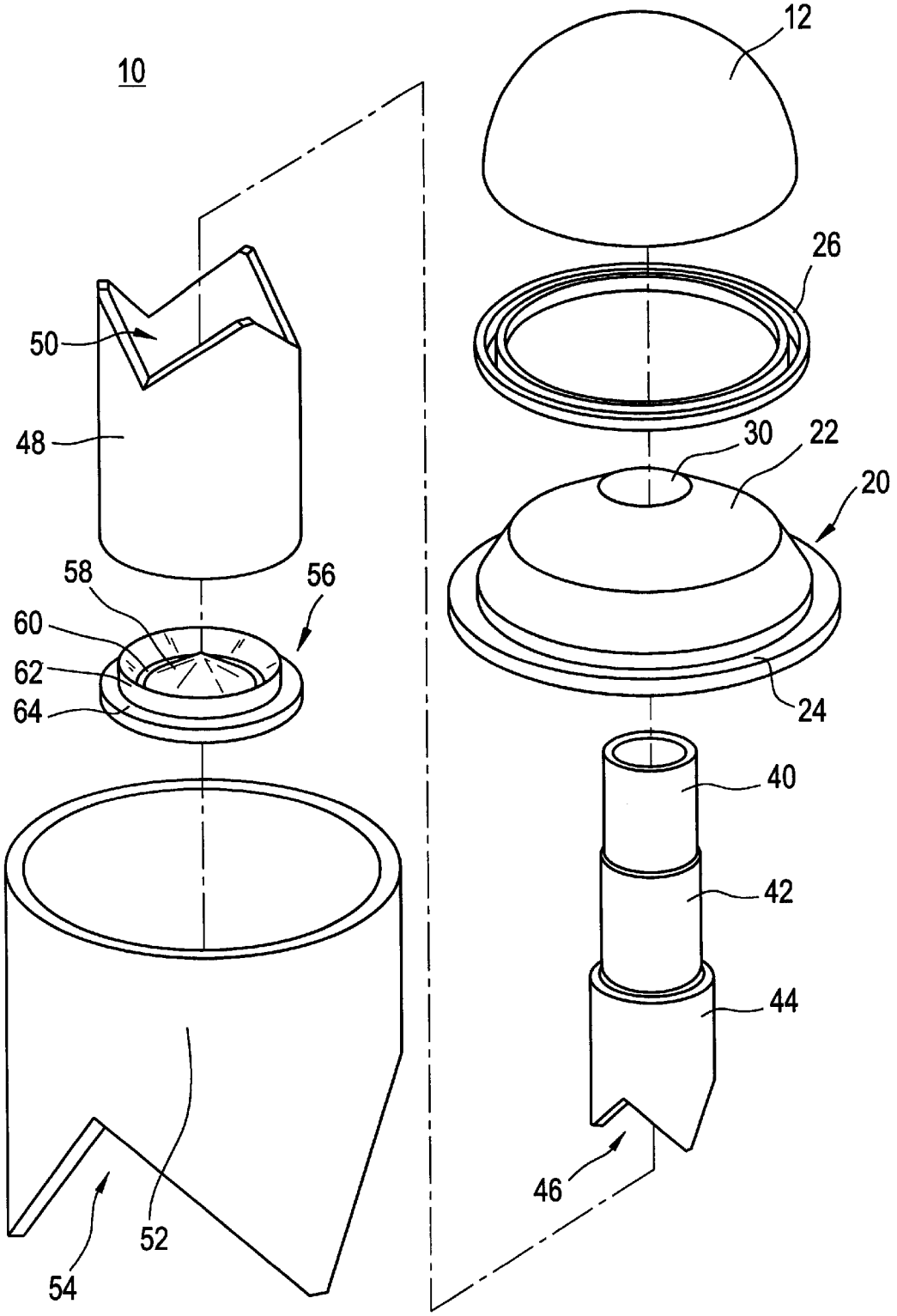
FIG. 3 is an exploded perspective view of the speaker shown in FIG. 1.

FIG. 1 is a perspective view showing one exemplary mode for the preferred embodiments of the invention, FIG. 2 is a partially sectional diagrammatic view thereof and FIG. 3 is an exploded perspective view thereof. A speaker 10 shown in FIGS. 1 through 3 preferably comprises a semispherical vibrator 12. The vibrator 12 preferably comprises a semispherical vibrating body 14 preferably made of a piezoelectric body formed of a material such as ceramics. Disposed on the curved inner and outer surfaces of the vibrating body 14, respectively, are electrodes 16*a* and 16*b* which function as a driving member for vibrating the vibrating body 14. The vibrating body 14 is preferably polarized in the direction of thickness thereof from the inner surface to the outer surface of the piezoelectric body 14, for example.

The vibrator 12 is secured to a horn 18 preferably made of synthetic resin, for example. The horn 18 preferably comprises an upper base 20 having a projection 22 which approximately corresponds to the shape of the vibrator 12 and a flange 24 disposed around the projection 22. The vibrator 12 is disposed so as to cover the projection 22 and is adhered on the flange 24 surrounding the projection 22 via a supporting member 26 preferably made of a ringed insulator having a groove. A cavity 28 for allowing the vibrator 12 to freely vibrate is provided between the vibrator 12 and the projection 22. It is noted that the electrodes 16*a* and 16*b* of the vibrator 12 are connected with input terminals (not shown) provided at the outside of the vibrator 12 preferably via a conductive ribbon which is connected with the electrode 16*a* at the inside and which is interposed between the upper base 20 and the supporting member 26 and a conductive ribbon which is connected with the electrode 16*b* at the outside thereof.

A hole 30 preferably having a substantially circular section is formed preferably at the approximate center of the upper base 20 so as to communicate with the cavity 28. The hole 30 preferably has stepped portions arranged so that the portion of the hole 30 located near the cavity 28 is the narrowest of the stepped portions. Further, the lower surface of the upper base 20 preferably includes an annular convex portion 32 preferably having a substantially triangular section formed so as to surround the hole 30, an annular flat portion 34 formed so as to surround the convex portion 32, an annular convex portion 36 preferably having a substantially triangular section and formed so as to surround the flat portion 34 and an annular flat portion 38 formed at the outermost part so as to surround the convex portion 36.

A first cylinder 40 and a second cylinder 42 having an aperture larger than that of the first cylinder 40 are secured to the hole 30 of the upper base 20. The inner surface of one end of the second cylinder 42 is connected to the outside of an end of the first cylinder 40 so as to define a stepped portion of the hole 30. The outer surface of the first cylinder 40 and the outer surface of one end of the second cylinder 42 are connected to the inner surface of the upper base 20 so as to define a portion of the hole 30. Further, the inner surface of one end of a third cylinder 44 having an aperture larger than that of the second cylinder 42 is connected to the outside of the other end of the second cylinder 42 to form another stepped portion of the hole 30. Three substantially V-shaped cutouts 46 are made preferably at equal intervals from each other and extend almost around the whole circumference of the other end of the third cylinder 44. Here, each cutout 46 is made so that it expands gradually as it gets closer to the end surface at the other end or bottom of the third cylinder 44.

A fourth cylinder 48 having an aperture larger than that of the third cylinder 44 is secured to the flat portion 34 of the upper base 20. That is, the fourth cylinder 48 is disposed around the second cylinder 42 and the third cylinder 44 so that the end of the third cylinder 44 having the apertures 46 extends downwardly. Three substantially V-shaped cutouts 50 are preferably provided at equal intervals from each other and extend almost around the whole circumference of the other end of the fourth cylinder 48. Here, each cutout 50 is made so as to expand gradually as it gets closer to the end surface of the other end of the fourth cylinder 48. The end surface of the other end of the fourth cylinder 48 is adhered to the flat portion 34 of the upper base 20. The three cutouts 50 of the fourth cylinder 48 are preferably disposed at circumferential positions corresponding to circumferential locations of the three cutouts 46 of the third cylinder 44. It is noted that the cutouts 50 of the fourth cylinder 48 may be disposed in a zigzag arrangement or alternatively with respect to the cutouts 46 of the third cylinder 44 plan-wise, instead of being disposed in rotational correspondence with the locations of the cutouts 46.

Further, a fifth cylinder 52 having an aperture larger than that of the fourth cylinder 48 is secured to the flat portion 38 of the upper base 20. That is, the fifth cylinder 52 is disposed around the fourth cylinder 48 so that one end of the fourth 48 cylinder having the apertures 50 extends upwardly. Three substantially V-shaped cutouts 54, which define openings of the sound path, are preferably made at equal intervals from each other and extend almost around the whole circumference of the other end of the fifth cylinder 52. Here, each cutout 54 is made so as to expand gradually as it gets closer to the end surface of the other end of the fifth cylinder 52. The end surface of one end of the fifth cylinder 52 is adhered to the flat portion 38 of the upper base 20. The three cutouts 54 of the fifth cylinder 52 are preferably disposed at rotational positions corresponding to the cutouts 46 of the third cylinder 44 and the cutouts 50 of the fourth cylinder 48. It is noted that the cutouts 54 of the fifth cylinder 52 may be disposed in a zigzag arrangement or alternatively with respect to the cutouts 50 of the fourth cylinder 48, instead of being disposed in rotational correspondence with locations of the cutouts 50 of the fourth cylinder 48.

The end surface of the other end of the third cylinder 44 and the end surface of one end of the fourth cylinder 48 are preferably secured to a disc-like lower base 56. That is, a substantially conical convex portion 58 is formed at the middle of the upper surface of the lower base 56, an annular flat portion 60 is formed so as to surround the convex portion 58, an annular convex portion 62 having a substantially triangular section is formed so as to surround the flat portion 60 and an annular flat portion 64 is formed at an outer-most point so as to surround the convex portion 62. The end surface of the other end of the third cylinder 44 and the end surface of one end of the fourth cylinder 48 are adhered to the flat portions 60 and 64 of the lower base 56, respectively.

In the horn 18, the sectional area thereof expands in a step-wise manner in order of the inner part of the first cylinder 40 which communicates with the cavity 28, the inner part of the second cylinder 42, the inner part of the third cylinder 44, the cutouts 46 of the third cylinder 44, the part created between the third cylinder 44 and the fourth cylinder 48, the part created between the second cylinder 42 and the fourth cylinder 48, the cutouts 50 of the fourth cylinder 48, the part created between the fourth cylinder 48 and the fifth cylinder 52, and the cutouts 54 of the fifth cylinder 52, thus forming the long south path. At this time, the sectional area S of each part which composes the sound path of the horn 18 preferably set so as to have a relationship of=ST $e^{mL}$, where ST is a sectional area of a throat portion (the narrowest portion at the beginning of the sound path), L is a distance from the throat portion to the center of each part which forms the sound path and m is a coefficient defined by a cutoff frequency of the horn 18, Accordingly, the sectional area of the sound path changes almost logarithmically, though step-wise, with respect to the length of the sound path in the horn 18 similarly to an exponential horn.

Further, the cavity 28 and the sound path are created such that the sound waves radiated from the curved outer surface of the vibrator 12 and the sound waves radiated from the curved inner surface of the vibrator 12 via the cavity 28 and the sound path have almost the same phase relative to a plane of speaker support and the plane of the floor so that those sound waves do not cancel each other out.

When an electrical signal is input to the input terminals, the vibrator 12 vibrates, thus radiating sound waves from the curved outer surface of the vibrator 12 and from the curved inner surface of the vibrator 12 via the cavity 28 and the sound path in the speaker 10.

At this time, because the vibrator 12 and the vibrating body 14 have a substantially semispherical shape, the sound waves radiated from the curved outer surface of the vibrator 12 are radiated away from the speaker support surface in all directions relative to the plane of speaker installation or support and the plane of the floor. Further, because the cutouts 54, i.e. the openings of the sound path are disposed along almost the entire circumference of the speaker, the sound waves radiated from the curved inner surface of the vibrator 12 via the cavity 28 and the sound path are radiated toward the speaker support surface in all directions relative to the speaker support surface.

An initial phase difference between the sound waves radiated from the curved outer surface of the vibrator 12 and the sound waves radiated from the curved inner surface of the vibrator 12 is 180°. However, those sound waves are caused to have almost the same phase relative to the plane of speaker installation or support or the plane of the floor by the cavity 28 and the sound path which function as a phase shifting device. Due to such a phase shifting device, in the speaker 10, those sound waves do not cancel each other out but are superimposed and have high sound pressure in directions relative to the plane of speaker installation or support and the plane of the floor.

Further, because the long sound path whose sectional area changes logarithmically, though step-wise, with respect to the length thereof is created in the horn 18, the speaker 10 is efficient in the low sound range.

Furthermore, because the sound path of the horn 18 is created by the plurality of cylinders which are arranged to have spaces therebetween, the speaker 10 has a substantially reduced size despite having the long sound path of the horn 18 and the efficiency in the low sound range.

Further, because the cutouts 46 and 50 which define the folded parts of the sound path of the horn 18 expand gradually as they get closer to the outer portion of the folded parts, the sound flows quickly at the portions where the distance of the sound path is longer, i.e. at the outer portion of the folded part of the sound path, and the sound flows slowly at the portion where the distance of the sound path is short, i.e. at the inner part of the folded part. As a result, the speeds of the sound waves become almost equal at the outer portion and the inner portion of the folded parts of the sound path and the flow of sound is hardly disturbed at the folded parts of the sound path. Thereby, the novel sound path structure allows nearly plane waves to be obtained and sound having less distortion to be obtained. In the same manner, the flow of sound is hardly disturbed at the cutouts 54, i.e. at the openings of the sound path of the horn 18, generating the nearly plane wave and sound having less distortion. In addition, because the first cylinder 40, the third cylinder 44, the fourth cylinder 48 and the fifth cylinder 52 may be readily positioned on the upper base 20 and the lower base 56, the speaker 10 is manufactured and assembled quickly and easily.

It is noted that although the vibrator in which the electrodes are disposed on the curved inner and outer surfaces of the vibrating body made of the piezoelectric body in the mode for carrying out the preferred embodiments of the present invention described above, it is possible to use a vibrator on which piezoelectric elements for vibrating a semispherical vibrating body are adhered as a driving device at part of the vibrating body made of metal, ceramics or synthetic resin, for example. Further, it is also possible to drive electromagnetically by using a voice coil.

Further, although the horn may be preferably made by synthetic resin in a preferred embodiments of the present invention described above, the horn may be made of metal, wood, ceramics, glass or the like.

In addition, although the center sound path is created by the first, second and third cylinders in the preferred embodiment of the present invention described above, the center sound path may be created by one, two, four or more cylinders.

Further, although the three cylinders which define the sound path of the horn are disposed to have spaces between adjacent cylinders and are centered around the central axis of the speaker in the preferred embodiments of the present invention described above, the number of the cylinders forming the sound path of the horn may be two, four or more.

It is noted that an elliptic cylinder or a square cylinder may be used as the cylinder defining the sound path of the horn.

Further, a cylinder having a path which expands gradually from one end to the other end may be used as the cylinder defining the sound path of the horn in the preferred embodiments of the present invention.

In addition, although the three substantially V-shaped cutouts have been formed in one cylinder in the preferred embodiments of the present invention described above, four or more substantially V-shaped cutouts may be made in one cylinder in the preferred embodiments of the present invention.

Further, it is possible to make cutouts having a shape other than the V-shape as the folded part and the opening of the sound path in the preferred embodiments of the present invention.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A speaker comprising:

a unitary piezoelectric oscillating body having a substantially hemispherical shape and including an outer surface and an inner surface;

a driver connected to the oscillating body for oscillating the oscillating body including a first driver connected to the outer surface of the oscillating body and a second driver connected to the inner surface of the oscillating body to drive the oscillating body; and a phase transfer device disposed at the inner surface of the oscillating body and arranged to phase transfer sound waves emitted from the inner surface of the oscillating body such that a sound wave emitted from the outer surface of the oscillating body and a sound wave emitted from the inner surface of the oscillating body are made to have substantially the same phase.

2. A speaker according to claim 1, wherein a horn is provided at the inner surface of the oscillating body.

3. A speaker according to claim 2, wherein said phase transfer device includes a hole provided within the horn and arranged to phase transfer sound waves from the inner surface of the oscillating body to outside of the speaker.

4. A speaker according to claim 2, wherein said phase transfer device includes a cavity located between the inner surface of the oscillating body and the horn.

5. A speaker according to claim 2, wherein the phase transfer device includes a path located between the horn and a surface upon which the speaker is supported.

6. A speaker according to claim 5, wherein said path is arranged to extend substantially along all directions relative to a direction that is substantially parallel to the surface upon which the speaker is supported.

7. A speaker according to claim 1, wherein the substantially hemispherical body includes a piezoelectric body.

8. A speaker according to claim 1, wherein the driving device includes a first driving electrode provided on the outer surface of the oscillating body and a second driving electrode provided on the inner surface of the oscillating body.

9. A speaker comprising:

an oscillating means for generating oscillation in response to an input signal, the oscillating means including a unitary piezoelectric body having a substantially hemispherical shape and including an outer surface and an inner surface;

means for driving the oscillating means including a first driving means connected to the outer surface and a second driving means connected to the inner surface for driving the oscillating means; and a phase transferring means for transferring sound waves emitted from the inner surface of the oscillating means such that a sound wave emitted from the outer surface of the oscillating means and a sound wave emitted from the inner surface of the oscillating means are made to have substantially the same phase.

10. A speaker according to claim 9, wherein a horn is provided at the inner surface of the oscillating means.

11. A speaker according to claim 10, wherein said phase transferring means includes a hole provided within the horn and arranged to phase transfer sound waves from the inner surface of the oscillating means to outside of the speaker.

12. A speaker according to claim 10, wherein said phase transferring means includes a cavity located between the inner surface of the oscillating means and the horn.

13. A speaker according to claim 10, wherein the phase transferring means includes a path located between of the horn and a surface upon which the speaker is supported.

14. A speaker according to claim 13, wherein said path is arranged to extend substantially along all directions relative to a direction that is substantially parallel to the surface upon which the speaker is supported.

15. A speaker comprising:

a substantially hemispherical oscillating body defined by a monolithic piezoelectric body having an inner surface and an outer surface; and a driving device including a first driving electrode provided on the outer surface of the oscillating body and a second driving electrode provided on the inner surface of the oscillating body; and a phase transfer device disposed at the inner surface of the oscillating body and arranged to phase transfer sound waves emitted from the inner surface of the oscillating body such that a sound wave emitted from the outer surface of the oscillating body and a sound wave emitted from the inner surface of the oscillating body are made to have substantially the same phase.

16. A speaker according to claim 15, wherein a horn is provided at the inner surface of the oscillating body.

17. A speaker according to claim 16, wherein said phase transfer device includes a hole provided within the horn and arranged to phase transfer sound waves from the inner surface of the oscillating body to outside of the speaker.

18. A speaker according to claim 16, wherein said phase transfer device includes a cavity located between the inner surface of the oscillating body and the horn.

19. A speaker according to claim 16, wherein the phase transfer device includes a path located between the horn and a surface upon which the speaker is supported.

20. A speaker according to claim 19, wherein said path is arranged to extend substantially along all directions relative to a direction that is substantially parallel to the surface upon which the speaker is supported.

21. A speaker comprising:

an oscillating device having a substantially hemispherical shape and including a piezoelectric body having an outer surface and an inner surface;

a driver connected to the oscillating device for oscillating the piezoelectric body and including a first driving electrode provided on the outer surface of the piezoelectric body and a second driving electrode provided on the inner surface of the piezoelectric body; and a phase transfer device disposed at the inner surface of the piezoelectric body and arranged to phase transfer sound waves emitted from the inner surface of the piezoelectric body such that a sound wave emitted from the outer surface of the piezoelectric body and a sound wave emitted from the inner surface of the piezoelectric body are made to have substantially the same phase.

22. A speaker according to claim 21, wherein a horn is provided at the inner surface of the piezoelectric body.

23. A speaker according to claim 22, wherein said phase transfer device includes a hole provided within the horn and arranged to phase transfer sound waves from the inner surface of the piezoelectric body to outside of the speaker.

24. A speaker according to claim 22, wherein said phase transfer device includes a cavity located between the inner surface of the piezoelectric body and the horn.

25. A speaker according to claim 22, wherein the phase transfer device includes a path located between the horn and a surface upon which the speaker is supported.

26. A speaker according to claim 25, wherein said path is arranged to extend substantially along all directions relative to a direction that is substantially parallel to the surface upon which the speaker is supported.

27. A speaker comprising:

a substantially hemispherical oscillating body having an inner surface and an outer surface, wherein the substantially hemispherical oscillating body includes a piezoelectric body, a driving device including a first driving electrode provided on the outer surface of the oscillating body and a second driving electrode provided on the inner surface of the oscillat ing body; and a phase transfer device disposed at the inner surface of the oscillating body and arranged to phase transfer sound waves emitted from the inner surface of the oscillating body such that a sound wave emitted from the outer surface of the oscillating body and a sound wave emitted from the inner surface of the oscillating body have substantially the same phase.

28. A speaker according to claim 27, wherein a horn is provided at the inner surface of the oscillating body.

29. A speaker according to claim 27, wherein a horn is provided at the inner surface of the oscillating body, and said phase transfer device includes a hole provided within the horn and is arranged to phase transfer sound waves from the inner surface of the oscillating body to the outside of the speaker.

30. A speaker according to claim 27, wherein said phase transfer device includes a cavity located between the inner surface of the oscillating body and the horn.

31. A speaker according to claim 27, wherein said phase transfer device includes a path located between the horn and a surface upon which the speaker is mounted.

32. A speaker according to claim 31, wherein said path is arranged to extend substantially along all directions relative to a direction that is substantially parallel to the surface upon which the speaker is supported.

* * * * *